United States Patent [19]

DiStefano et al.

[11] Patent Number: 4,511,438

[45] Date of Patent: Apr. 16, 1985

[54] BI-METALLIC ELECTROFORMING TECHNIQUE

[75] Inventors: Ralph D. DiStefano, Palm Bay; Nicholas Moldovan, Indian Harbor Beach, both of Fla.

[73] Assignee: Harris Corporation, Melbourne, Fla.

[21] Appl. No.: 534,074

[22] Filed: Sep. 20, 1983

Related U.S. Application Data

[63] Continuation of Ser. No. 482,206, Apr. 5, 1983, abandoned.

[51] Int. Cl.[3] ..... C25D 1/00; C25D 1/02

[52] U.S. Cl. ..... 204/4; 204/9

[58] Field of Search ..... 204/3, 4, 9, 38 B, 38 S, 204/40

[56] References Cited

U.S. PATENT DOCUMENTS

| | | | |
|---|---|---|---|
| 2,592,614 | 4/1952 | Stoddard, Jr. | 204/9 |
| 2,826,524 | 3/1958 | Molloy | 154/83 |
| 2,898,273 | 8/1959 | La Forge, Jr. | 204/9 |
| 3,341,432 | 9/1967 | Kadner | 204/9 |
| 3,947,348 | 3/1976 | Schabernack | 204/9 |
| 4,295,142 | 10/1981 | Thiere | 343/781 CA |

FOREIGN PATENT DOCUMENTS

| | | | |
|---|---|---|---|
| 685247 | 12/1952 | United Kingdom | 204/9 |

OTHER PUBLICATIONS

Rodgers, Handbook of Practical Electroplating, 1959, pp. 136–157.

Electroplating Engineering Handbook, 3rd Ed., Edited by A. K. Graham, 1971, p. 240.

*Primary Examiner*—Thomas Tufariello

*Attorney, Agent, or Firm*—Antonelli, Terry & Wands

[57] ABSTRACT

A method of forming articles on an electrically conductive mandrel, and the article produced, is disclosed. Initially, a first layer of metal is electroformed on the mandrel; then alternating electrolessly deposited metal layers of, e.g., two different metals are deposited on the electroformed first layer to form a bi-metallic laminated structure; and then a final layer of metal is electroformed on the laminated structure. The mandrel is then removed to form the article. This method provides a more uniform wall thickness of the final article, even when the mandrel has inner wall portions (e.g., grooves, slots, holes, etc.), as compared with articles formed by conventional electroforming techniques. This method can be used, among other uses, to form corrugated waveguide horns for extremely high frequency applications.

64 Claims, 2 Drawing Figures

BI-METALLIC ELECTROFORMING TECHNIQUE

This application is a continuation of application Ser. No. 482,206, filed Apr. 5, 1983 now abandoned.

The invention relates in general to a method, including electroforming steps, for forming metal articles on mandrels (or matrices), particularly on, e.g., mandrels having inner and outer wall portions (the inner wall portions constituting, e.g. grooves, slots, holes, etc.), where the metal is formed on the inner wall portions, and more particularly where the inner wall portions of the mandrel have a greater depth than width, for example, a depth:width ratio of greater than 2:1, and the articles formed thereby.

Although this invention has utility in forming any number of different kinds of articles, such as those formed by conventional electroforming on a mandrel, it will be described below in terms of forming corrugated waveguide horns for EHF (extremely high frequency) applications (i.e., where the mandrel has a negative form of a corrugated waveguide horn).

BACKGROUND OF THE INVENTION

Forming of metal articles, e.g., waveguides, using electroforming techniques, is known. Thus, in U.S. Pat. No. 2,826,524 to Molloy there is described an electroforming process for forming wave-transmitting elements, such as a hollow waveguide, a feed horn, etc., wherein initially an internal mandrel whose outside surface corresponds to the inside configuration of the waveguide is formed; a metal coating, which is formed by electrodeposition, is formed on the mandrel, reinforcing material is then provided on the metal coating, and the mandrel is then removed (e.g., by mechanical removal, or melting, or dissolution).

Problems arise, however, particularly when known electroforming techniques are utilized for forming metal articles on such mandrels having inner wall portions (e.g., slots, grooves, holes, etc.). In particular, there is a problem with providing sufficient material and uniformity on the inner wall portions to provide a final electroformed product with adequate strength and thickness, e.g., at the position corresponding to such inner wall portions. Thus, in the conventional electroforming method a heavy (i.e., thick) electrodeposit is caused to build up on the outside corners of the inner wall portions, that is, the high current density areas, while the electrodeposit remains thin on the inside walls.

British Pat. No. 685,247 describes a method of forming a metallic structure by electrodeposition on a mandrel, the mandrel having a sharp re-entrant angle, and describes the problem of depositing metal electrolytically in the sharp re-entrant angle since, in practice, electroforming on a structure including such angles results in thin, weak deposits in the angle and the formation of a deep crevice penetrating to the edge at which the walls forming the angle meet. This British patent attempts to overcome this problem by first electrodepositing a thin metallic deposit on the mandrel, including the sharp re-entrant angle, then packing the re-entrant corners with suitable metallic powder, and, after cleaning or preparation of the surfaces as may be necessary, then returning the mandrel to the plating bath to continue electrodeposition until the desired wall thickness has been built up. This British patent further discloses that the metallic powder with which the corners are packed may be precipitated silver which may be tamped into the corners.

As can be appreciated, even when the metallic powders are tamped into the corners, problems can arise with respect to adhesion of the layers and powder. Moreover, the final electroformed article would not be substantially uniform, among other reasons because the corners of the re-entrant angles would contain the metal powder. Furthermore, it is extremely difficult to utilize a method such as described in the British patent wherein metallic articles are formed on mandrels with inner wall portions having large depth-to-width ratios.

U.S. Pat. No. 2,898,273 to La Forge, et al. discloses an electrodeposition method for forming disc-loaded waveguides, wherein a plating core, i.e., mandrel, is formed by machining internal grooves into an aluminum cylinder, and then copper or silver is electroformed onto the plating core, and then the plating core is dissolved out. This patent discloses the problem of more rapid metal deposition at the outer than at the inner portions of the core grooves and the tendency for the plating metal to seal over the outer portions of the grooves before the grooves are completely filled with metal, which leaves cavities filled with entrapped plating solution; and describes an attempted solution to such problem of providing passages for escape of such entrapped plating solution by positioning threads of "Orlon" or the like transversely within the grooves of the plating core prior to or during the electrodeposition, and then burning the threads, to provide such passages, after the electroplating.

Thus, La Forge provides an overly thick coating at the outer groove portions as compared with the coating at the inner groove portions. Moreover, such procedure as described by La Forge would not solve the problem of providing sufficient coating thickness at the inner groove portions for grooves having a high depth-to-width ratio.

This problem of providing sufficient material and uniformity on the inner wall portions of the mandrel to provide a final article with adequate strength and thickness becomes more acute as the depth-to-width ratio of the inner wall portions become greater, especially as they become greater than 2:1. An example of an article to be formed utilizing mandrels with such large depth-to-width ratios are corrugated waveguide horns for extremely high frequency (EHF) application, e.g., millimeter corrugated horns. Such corrugated horns are very small and have very tight tolerances. These horns, and uses therefor, are known; see, for example, U.S. Pat. No. 4,295,142, issued Oct. 13, 1981, naming Thiere, et al. as the inventors. These horns have corrugations which, as an example, can be about 250 mils long and 90–300 mils wide. Such horns would be made utilizing mandrels having inner wall portions (e.g., narrow slots or grooves), with a depth of about 250 mils and a width as low as 90 mils.

SUMMARY OF THE INVENTION

Accordingly, it is an object of this invention to provide a method of forming articles, utilizing steps of electroforming metallic layers on a mandrel, wherein a more uniform and thicker metal distribution is provided, to form a product having sufficient material and uniformity for adequate strength and thickness, as well as to provide a formed article having such more uniform and thicker metal distribution.

Moreover, it is a further object of this invention to provide such a method of forming articles, utilizing steps of electroforming on a mandrel, as well as the article formed, wherein a more uniform and thicker metal distribution is provided notwithstanding that the mandrel has inner wall portions (e.g., holes, slots, grooves, corrugations, etc.).

Moreover, it is a further object of this invention to provide such a method of forming articles, including electrodeposition on a mandrel having inner wall portions, the inner wall portions having a large depth-to-width ratio (e.g., a depth-to-width ratio greater than 2:1), and the article formed, wherein uniform and thicker metal distribution is provided in the deep, narrow inner wall portions.

Moreover, it is a further object of this invention to provide such a method of forming articles, including electrodeposition of layers on a mandrel having inner wall portions, wherein there arises no problems of delamination of the layers after forming the article.

Moreover, it is a further object of this invention to form corrugated waveguide horns for EHF application, such as millimeter corrugated horns, utilizing electroforming of metal on a mandrel, wherein sufficient material and uniformity are provided in the deep, narrow grooves of the mandrel to form a horn having adequate structural strength.

Such objects are achieved by an electroforming technique, utilizing both conventional electroforming and electroless deposition techniques, to form a laminated structure sandwiched between electroformed layers. More particularly, an article with, e.g., corrugations corresponding to inner wall portions of the mandrel, can be provided by electroforming an initial metal layer on the mandrel surface; then providing alternating layers of at least two metals, at least part of each of these alternating layers being formed by electroless plating, to build up the thickness; and then electroforming a final layer. The article is then freed from the mandrel. Moreover, by activating the preceding layer prior to forming an electrolessly deposited metal layer thereon, so that the succeeding layer is formed on a substrate that is not passivated, any problem of delamination of the layers can be helped to be alleviated. Thus, the laminated structure formed between the first and final electroformed layers, each of which layers of the laminated structure are formed at least in part by electroless plating, acts to provide a more uniform metal distribution on the mandrel, particularly when the mandrel has an uneven surface (e.g., has inner wall portions).

DETAILED DESCRIPTION OF THE INVENTION

Figure 1:
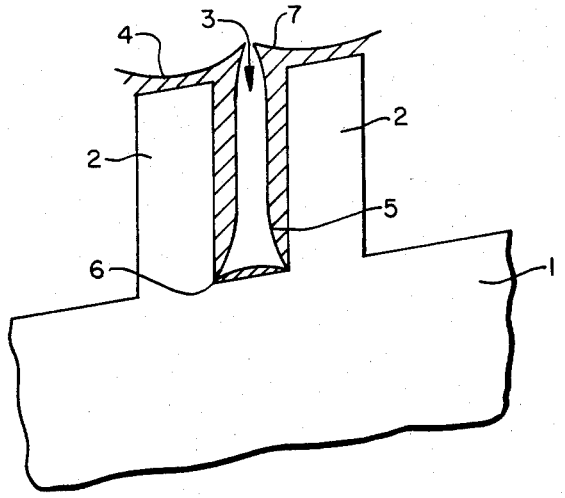
FIG. 1 comprises a sectional view through a mandrel, showing an inner wall portion, and illustrating an electroformed layer formed on said mandrel, including on said inner wall portion, by conventional electroforming techniques.

FIG. 1 illustrates the problem of electroforming an article on a mandrel having inner and outer wall portions using conventional electroforming techniques. Thus, shown in FIG. 1 is mandrel 1 having portions 2 forming an inner wall portion 3. The electroformed layer 4, deposited by conventional electroforming techniques (e.g., conventional copper electroforming techniques) has thicker portions 7 on outside corners (high current density areas) of the mandrel and very thin portions 5 on the inside wall. Moreover, the electroformed layer can substantially disappear at the inside corners 6. As can be appreciated from FIG. 1, this electroformed layer 4 would not have sufficient material distribution and uniformity for adequate strength after removal of the mandrel 1.

Figure 2:
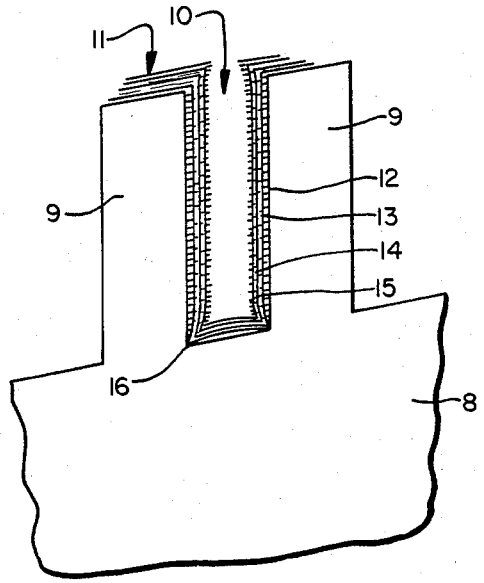
FIG. 2 comprises a sectional view through a mandrel, showing an inner wall portion, and illustrating the layers formed on said mandrel, including on said inner wall portion, utilizing the presently described invention.

FIG. 2, on the other hand, shows the much more uniform metal coating provided on the mandrel, particularly on the inner wall portions thereof, utilizing the presently described invention, as compared with a conventional electroforming process. In FIG. 2, reference character 8 denotes a mandrel, with portions 9 forming an inner wall portion 10. The bi-metallic coating technique of the present invention provides a coating 11 that is much more uniform and, in particular, provides adequate material and uniformity on the inner wall portions 10, including at the inner edges 16 so that, upon removal of the mandrel 8, the remaining structure has sufficient strength.

As can be seen in FIG. 2, this coating 11 is comprised of a plurality of layers: a first electroformed layer 12 (e.g., of copper); a first electrolessly deposited layer 13 of a first metal (e.g., a nickel electrolessly deposited layer); a second electrolessly deposited layer 14 of a second metal (e.g., a copper electrolessly deposited layer); and a final electroformed layer 15 (e.g., of copper). Although this FIG. 2 shows a single electrolessly deposited layer of a first metal and a single electrolessly deposited layer of a second metal, additional electrolessly deposited layers of the two metals, with, e.g., alternating electrolessly deposited layers of the first and second metals, can be provided between the first and final electroformed layers. As can be appreciated, the number of electrolessly deposited layers utilized depends upon the desired final thickness of the coating 11 (i.e., the desired wall thickness of the article formed on the mandrel) and the thickness of the first and final electroformed layers, which are governed at least in part by the required degree of uniform thickness of the coating 11.

The present invention will now be described with respect to its application to forming a corrugated waveguide horn for EHF applications. Such description, including the application to a specific use, specific metals used, and specific activation procedure, is exemplary of the present invention, and applicants do not intend to be limited thereto.

Initially, a mandrel having a surface which is a negative form of the desired surface of the corrugated waveguide horn (that is, having, e.g., grooves corresponding to the projecting portions of the waveguide horn) is placed in a copper electrodeposition bath for an initial electrodeposited coating of copper of, e.g., 10–15 mils. The mandrel can be made of conductive material which is inert to materials utilized in forming the waveguide horn, described below, and which can be removed after forming the article without damaging the article. Exemplary materials for making the mandrel include aluminum, as is known in the electroforming art. The copper electrodeposition bath can be a conventional acid copper electroforming bath, including brighteners added, e.g., during the electrodeposition, as is known in the art.

This electroformed coating is provided having a thickness so that a smooth layer is formed, with no nodules. As can be appreciated, this electroformed layer should have a very smooth surface formed adjacent the mandrel in order to form an effective waveguide horn. As an example, the initial electrodeposited copper coating can be formed on the mandrel in a conventional acid copper electroplating bath at a current plating density of 40–50 amps/ft$^2$ for six hours, with the mandrel as the cathode.

After the initial electrodeposition, the electrodeposited layer is activated for electroless deposition of, e.g., nickel, on the electrodeposited copper layer. The purpose of this activation, as well as succeeding activation steps, is to present an active surface, rather than a passivated surface, for the next, e.g., electroless deposition; deposition on such active (i.e., non-passivated) surface helps provide a good deposited layer thereon, increases adhesion between the layers, and helps prevent later delamination of the layers. As an example, the copper electrodeposited layer is activated by dipping in an aqueous solution containing 20% by volume sodium persulfate and 5% by volume sulfuric acid for 30–60 seconds.

It is preferred that the activated layer is passed to the nickel electroless deposition bath as soon as possible after activation in order to prevent any passivation, or re-passivation, of the copper electroformed layer prior to electroless nickel deposition.

The mandrel having the activated electrodeposited layer thereon is then passed into a conventional electroless nickel plating bath, to deposit a nickel layer, e.g., preferably 2–3 mils thick on the electrodeposited layer. It is preferred that the electrolessly deposited layer be as thick as possible, in order to limit the total number of layers. However, the electroless Ni layer is preferably limited to a maximum thickness of 3 mils, since with greater thicknesses the electrolessly plated layer is brittle. The electroless Ni plating of the desired thickness can be formed by leaving the mandrel with the electroformed copper coating thereon in the electroless Ni plating bath for about 2½ hours.

After forming the electroless Ni layer, the plated mandrel is then placed in, e.g., a conventional Rochelle salt cyanide copper strike bath in order to activate the electroless nickel layer, to form an electrodeposited copper layer thereon and present an activated surface for the succeeding electroless deposition, e.g., a copper electroless deposition. Such Rochelle salt cyanide copper strike baths are well known in the art, and are described, together with the procedure for forming a copper strike layer, in Rodgers, *Handbook of Practical Electroplating* (The Macmillan Company 1959), pages 136–139; and *Electroplating Engineering Handbook* (3d Ed., ed. by A. K. Graham, published by Van Nostrand Reinhold Co. 1971), page 240, the disclosures of which are incorporated herein by reference. The treatment in the Rochelle salt cyanide copper strike bath activates the nickel layer and electrodeposits a layer of copper on the nickel layer. One of the following two alternative procedures can be utilized in the Rochelle salt cyanide copper strike bath: (1) provide only a strike coating on the nickel layer (e.g., by electrodepositing copper for 2–5 minutes); or (2) electrodeposit a copper layer 1–2 mils thick on the nickel layer, from the Rochelle salt strike bath, the layer being formed by plating for ½ hour while agitating the bath to form a smooth layer.

Whichever of the two alternatives described in the immediately preceding paragraph is utilized, the coated mandrel is then transferred into a conventional copper electroless plating bath to form an electroless copper layer on the layer formed in the Rochelle salt cyanide copper strike bath. Such electroless copper layer can be formed by performing the electroless copper deposition for 4 hours. The total thickness of the copper coating formed utilizing the Rochelle salt cyanide copper strike bath and the copper electroless plating bath is preferably 2–3 mils. If more than a total 3-mil thickness copper coating is formed, then undesirably the deposit is grainy, rather than smooth. Of course, the copper coating deposited on the electroless Ni layer is as large as possible, so as to preferably limit the total number of coating layers.

After forming this copper coating, a part of which is deposited by electroless deposition, the copper coating is activated and is then transferred into a conventional electroless nickel plating bath for deposition of a second nickel layer, on the copper coating. The activation can be achieved, e.g., by dipping the copper-coated article in an aqueous solution containing 20% by volume sodium persulfate and 5% by volume sulfuric acid for 30–60 seconds, as discussed previously with respect to activation of the first electroformed layer. The second electrolessly deposited nickel layer formed on the copper coating has a preferred thickness of 2–3 mils, the maximum of 3 mils being so that the electrolessly deposited nickel layer is not brittle, as discussed previously with respect to the first electrolessly deposited nickel layer. This second electroless nickel layer can be formed by performing the electroless nickel plating for 2½ hours, as was done in forming the first electroless nickel layer.

Alternating layers of the copper coating and electroless nickel coating are then applied, until a predetermined thickness is reached. For example, in forming the corrugated waveguide horn, a total of three electroless nickel layers and three copper coatings were utilized. Then the coated mandrel, with a first electrodeposited layer of copper and then alternating electroless nickel layers, and copper coatings, thereon, is transferred, e.g., to a conventional acid copper electroplating bath, e.g., after the third copper coating is formed, and then a final electroformed layer is deposited. This final electroformed layer is preferably of copper, but can be of silver, and is of a thickness (e.g., 24–30 mils) to provide strength to the final article. It must be noted that copper is preferred due to its lower cost. The final electroformed copper layer is deposited while the coated mandrel is in an acid copper electroforming bath, at a current density of 40–50 amps/ft$^2$ for 24–40 hours, with the coated mandrel as the cathode.

After formation of the final electrodeposited layer, the bi-metallic horn structure is heat-treated (e.g., for 24 hours at 200°–250° F.) to relieve any hydrogen embrittlement; the ends of the coated mandrel are machined mechanically, by conventional means, in order to prepare the corrugated waveguide horn for fitting connections thereto, and then the mandrel is removed, e.g., by etching as is well known in the art.

After removal of the mandrel, the remaining article is dipped in a bright dip solution to clean the inside surface of the article, e.g., clean out the smut remaining after removal of the mandrel. Bright dip solutions for this intended purpose of cleaning the inside surface of an article after removal of the mandrel are known. Then the structure is heat-treated for 4–5 hours at 400°–450° F. to ensure that no separation occurs between layers of nickel and copper.

Thus, a corrugated waveguide horn for EHF applications, having a total thickness (of electrodeposited initial and final layers and bi-metallic laminated structure of electrolessly deposited nickel layers and copper coatings) of 40–50 mils, with sufficient metal wall thickness, including in the corrugations, to achieve the needed structural strength, is provided.

As can be appreciated from the foregoing, by combining the conventional electroforming process, such as a conventional copper electroforming process, with, e.g., electroless nickel and electroless copper plating techniques, articles can be formed, on mandrels, having more uniform wall thicknesses, notwithstanding that the mandrels have narrow inner wall portions (e.g., narrow slots, grooves, etc.).

In summary, the presently described invention includes the following steps to form articles, on mandrels having outer and inner wall portions, with more uniform wall thicknesses, even at those positions corresponding to the inner wall portions of the mandrel, and wherein there is less problem with delamination of the laminated structure of the wall:

(a) electroforming a first layer on the mandrel;

(b) forming a laminate structure by forming alternating layers of different metals, each of these layers being formed at least in part by electroless deposition, with the layer on which the immediately succeeding electrolessly deposited metal layer is formed being activated prior to the electroless deposition; and (c) electroforming a final layer, as a wraparound layer, on the laminate structure.

While the present invention has been described most specifically in terms of forming corrugated waveguide horns for EHF application, utilizing copper for the first and final electroformed layers and utilizing nickel and copper for the electrolessly deposited layers, with specific activation of the layers on which the electrolessly deposited layers are formed, the invention is not so limited, and has application in forming many articles formed on a mandrel and utilizing electroforming steps, to provide a more uniform wall thickness, particularly when the mandrel on which the article is formed has inner wall portions (e.g., grooves, slots, etc.) having a depth-to-width ratio of greater than 2:1. As an example, the presently described method has use in forming molds for use in the plastics industry. The present invention is susceptible of numerous changes and modifications as known to one having ordinary skill in the art and we therefore do not wish to be limited to the details shown and described herein, but intend to cover all such modifications as are encompassed by the scope of the appended claims.

What is claimed is:

1. A process for forming an article on an electroforming mandrel, said article having a sufficiently uniform wall thickness to provide a final article with adequate strength, comprising the steps of:

(a) electroforming a first layer on said mandrel, said first layer being thicker on first portions of said mandrel than on other portions of said mandrel;

(b) electrolessly depositing a plurality of layers on said first layer, said plurality of layers having a more uniform thickness than said first layer; and (c) electroforming a final layer on said plurality of layers.

2. A process for forming an article according to claim 1, wherein said first layer, each of the plurality of layers, and said final layer are metal layers.

3. A process for forming an article according to claim 2, wherein said first layer is thicker on higher current density areas on said mandrel than on lower current density areas.

4. A process for forming an article according to claim 3, wherein said plurality of layers include layers made of different metals, with adjacent layers being formed of different materials.

5. A process for forming an article according to claim 4, wherein each of the plurality of layers, on which a further one of said plurality of layers is formed, is formed to be in an activated state to provide sufficient adherance of the succeeding layer thereto.

6. A process for forming an article according to claim 5, wherein the first layer is formed to be in an activated state to provide sufficient adherence of the first layer of said plurality of layers thereto.

7. A process for forming an article according to claim 6, wherein after electroforming said final layer, the mandrel is removed from the formed metal layers.

8. A process for forming an article according to claim 6, wherein each of said plurality of layers have a more uniform thickness than said first layer.

9. A process for forming an article according to claim 4, wherein the plurality of layers are formed of a first metal and a second metal, with alternating layers being made of said first metal and said second metal.

10. A process for forming an article according to claim 9, wherein the first and second metals are copper and nickel.

11. A process for forming an article according to claim 1, wherein said mandrel on which the article is formed has outer wall portions and inner wall portions.

12. A process for forming an article according to claim 1, wherein each of said plurality of layers have a more uniform thickness than said first layer.

13. Product formed by the process of claim 1.

14. Product formed by the process of claim 2.

15. Product formed by the process of claim 4.

16. A process for forming an article according to claim 6, wherein said mandrel is made of an electrically conductive material.

17. A process for forming an article according to claim 5, wherein each of the plurality of layers are formed to be in an activated state by electrolessly depositing each layer and, after depositing each layer, then activating that layer.

18. A process for forming an article according to claim 17, wherein the first layer is formed to be in an activated state to provide sufficient adherence of the first layer of said plurality of layers thereto.

19. A process for forming an article according to claim 18, wherein the first layer is formed to be in an activated state by electroforming said first layer on said mandrel and then activating said first layer prior to electrolessly depositing a plurality of layers thereon.

20. A process for forming an article according to claim 19, wherein each of said plurality of layers have a more uniform thickness than said first layer.

21. A process for forming an article according to claim 1, wherein the electrolessly deposited layers are formed to extend continuously on said first layer.

22. A process for forming an article on an electrically conductive mandrel, including steps of electroforming, the mandrel having outer wall portions and inner wall portions, comprising the steps of:

(a) electroforming a first electrodeposited metal layer on said electrically conductive mandrel;
(b) activating the first electrodeposited metal layer;
(c) forming an electrolessly deposited layer of a first metal on the activated electrodeposited metal layer;
(d) activating the electrolessly deposited layer of a first metal;
(e) forming an electrolessly deposited layer of a metal different than the first metal on the activated electrolessly deposited layer of a first metal; and
(f) electroforming a final electrodeposited metal layer on said electrolessly deposited layer of a metal different than the first metal.

23. A process for forming an article according to claim 22, wherein, after the step f), the electrically conductive mandrel is removed from the formed metal layers.

24. A process for forming an article according to claim 23, further including, after step d) and before step e), the following steps:

$(d)_1$ forming another electrolessly deposited layer of a metal different than the first metal on the activated electrolessly deposited layer of a first metal;
$(d)_2$ activating the another electrolessly deposited layer of a metal different than the first metal;
$(d)_3$ forming another electrolessly deposited layer of the first metal on the activated another electrolessly deposited layer of a metal different than the first metal; and
$(d)_4$ activating the another electrolessly deposited layer of the first metal.

25. A process for forming an article according to claim 24, wherein the steps $d)_1$ through $d)_4$ are repeated at least once in order to provide a laminated structure of a predetermined thickness between the first and final electroformed metal layers.

26. A process for forming an article according to claim 22, wherein said first metal is nickel and said metal different than the first metal is copper.

27. A process for forming an article according to claim 25, wherein the first electrodeposited metal layer is a copper layer, said first metal is nickel, and said metal different than the first metal is copper.

28. A process for forming an article according to claim 27, wherein the first electrodeposited copper layer is deposited on the mandrel from an acid copper bath.

29. A process for forming an article according to claim 27, wherein the first electrodeposited copper layer and electrolessly deposited copper layers are activated by dipping in an aqueous solution of 20% by volume sodium persulfate and 5% by volume sulfuric acid.

30. A process for forming an article according to claim 29, wherein the electrolessly deposited nickel layers are activated by transferring the coated mandrel having an exposed electrolessly deposited nickel layer into a Rochelle salt-containing cyanide copper plating bath and electroplating a copper strike layer thereon.

31. A process for forming an article according to claim 30, wherein the maximum thickness of each of the electrolessly deposited nickel layers is 3 mils, and the maximum total thickness of each copper strike layer and adjacent copper electrolessly deposited layer is 3 mils.

32. A process for forming an article according to claim 29, wherein the electrolessly deposited nickel layers are activated by transferring the coated mandrel having an exposed electrolessly deposited nickel layer into a Rochelle salt-containing cyanide copper plating bath and electrodepositing a smooth copper layer of 1–2 mils thereon.

33. A process for forming an article according to claim 32, wherein the maximum thickness of each of the electrolessly deposited nickel layers is 3 mils, and the maximum total thickness of each smooth copper layer and adjacent electrolessly deposited copper layer is 3 mils.

34. A process for forming an article according to claim 27, including the further step of heat treating the formed structure after step f) to relieve any hydrogen embrittlement.

35. A process for forming an article according to claim 34, comprising the further step of subjecting the formed article after removal of the mandrel to an additional heat treatment at 400°–450° F. to insure no separation occurs between layers of nickel and copper.

36. A process for forming an article according to claim 22, wherein said inner wall portions of the mandrel have a depth-to-width ratio greater than 2:1.

37. A process for forming an article according to claim 22, wherein the mandrel has the negative form of a corrugated waveguide horn for EHF applications, whereby the article formed is a corrugated waveguide horn for EHF applications.

38. Product formed by the process of claim 22.
39. Product formed by the process of claim 23.
40. Product formed by the process of claim 27.
41. Product formed by the process of claim 36.
42. Product formed by the process of claim 37.

43. A process for forming a corrugated waveguide horn for EHF applications including steps of electroforming on an electrically conductive mandrel having a negative form of the corrugated waveguide horn, comprising:

(a) electroforming a first copper layer on said electrically conductive mandrel;
(b) activating the electroformed first copper layer;
(c) electrolessly depositing a nickel layer on the activated electroformed first copper layer;
(d) activing the electrolessly deposited nickel layer;
(e) electrolessly depositing a copper layer on the activated electrolessly deposited nickel layer;
(f) electroforming a final layer of copper on the electrolessly deposited copper layer; and
(g) removing the mandrel.

44. A process for forming a corrugated waveguide horn according to claim 43, further including after step d) and before step e), the following steps:

$(d)_1$ electrolessly depositing another copper layer on the activated electrolessly deposited nickel layer;
$(d)_2$ activating the electrolessly deposited another copper layer;
$(d)_3$ electrolessly depositing another nickel layer on the activated electrolessly deposited another copper layer; and
$(d)_4$ activating the electrolessly deposited another nickel layer.

45. A process for forming a corrugated waveguide horn according to claim 44, wherein the steps $d)_1$ through $d)_4$ are repeated at least once in order to provide a laminated structure of a predetermined thickness between the electroformed first and final copper layers.

46. A process for forming a corrugated waveguide horn according to claim 45, wherein the steps $d)_1$ through $d)_4$ are repeated once.

47. A process for forming a corrugated waveguide horn according to claim 46, wherein, after step g), the formed structure is heat-treated at 400°–450° F. for 4 hours to ensure no separation occurs between layers of nickel and copper.

48. A process for forming a corrugated waveguide horn according to claim 47, wherein after step f) and before step g), the structure is heat-treated at 200°–250° F. for 24 hours to remove any hydrogen embrittlement.

49. A process for forming a corrugated waveguide horn according to claim 48, wherein the electroformed first copper layer and electrolessly deposited copper layers are activated by dipping the exposed copper layer in an aqueous solution containing 20% by volume sodium persulfate and 5% by volume sulfuric acid.

50. A process for forming a corrugated waveguide horn according to claim 49, wherein the electrolessly deposited nickel layers are activated by electrodepositing a copper strike layer on each nickel layer from a Rochelle salt-containing cyanide copper plating bath.

51. A process for forming a corrugated waveguide horn according to claim 50, wherein the first electroformed copper layer has a thickness of 10–15 mils, each of the electrolessly deposited nickel layers has a thickness of 2–3 mils, the total thickness of the copper strike layer and adjacent electrolessly deposited copper layer is 2–3 mils, and the electroformed final copper layer has a thickness of 24–30 mils.

52. A process for forming a corrugated waveguide horn according to claim 47, wherein the electrolessly deposited nickel layers are activated by electrodepositing a smooth copper layer, having a thickness of 1–2 mils, on each nickel layer, from a Rochelle salt-containing cyanide copper plating bath.

53. A process for forming a corrugated waveguide horn according to claim 52, wherein the thickness of the electroformed first copper layer is 10–15 mils, the thickness of each of the electrolessly deposited nickel layers is 2–3 mils, the total thickness of each electrodeposited smooth copper layer and adjacent electrolessly deposited copper layer is 2–3 mils, and the thickness of the electroformed final copper layer is 24–30 mils.

54. A process for forming a corrugated waveguide horn according to claim 43, wherein said mandrel is made of aluminum, and has inner wall portions with a depth of 250 mils and a width of 90–300 mils.

55. Product formed by the process of claim 43.

56. Product formed by the process of claim 46.

57. Product formed by the process of claim 51.

58. Product formed by the process of claim 53.

59. A process for forming an article on an electroforming mandrel, the article having a sufficiently uniform wall thickness to provide a final article with adequate strength, comprising the steps of:

(a) electroforming a first layer on said mandrel, said first layer being thicker on first portions of the mandrel than on other portions thereof;

(b) electrolessly depositing a second layer on said first layer, said second layer having a more uniform thickness than said first layer; and (c) electroforming a final layer on said second layer.

60. A process for forming an article according to claim 59, wherein said first layer, said second layer and said final layer are metal layers.

61. A process for forming an article according to claim 60, wherein said second layer is deposited to extend continuously on said first layer.

62. A process for forming an article according to claim 61, wherein the first layer is formed to be in an activated state to provide sufficient adherence of the second layer thereto.

63. A process for forming an article on an electroforming mandrel, including steps of electroforming, the mandrel having outer wall portions and inner wall portions, comprising the steps of:

(a) electroforming a metal layer on said mandrel;

(b) activating the electroformed metal layer;

(c) electrolessly depositing a layer of a first metal on the activated electroformed metal layer;

(d) activating the electrolessly deposited layer of the first metal; and (e) electroforming a final metal layer on the activated electrolessly deposited layer.

64. A process for forming an article according to claim 63, wherein the electrolessly deposited layer is deposited to extend continuously on the electroformed metal layer.

* * * * *